United States Patent [19]

Price et al.

[11] Patent Number: 4,741,667

[45] Date of Patent: May 3, 1988

[54] STATOR VANE

[75] Inventors: Francis R. Price, Glastonbury; Charles B. Titus, West Hartford, both of Conn.

[73] Assignee: United Technologies Corporation, Hartford, Conn.

[21] Appl. No.: 868,397

[22] Filed: May 28, 1986

[51] Int. Cl.[4] ..... F01D 9/02

[52] U.S. Cl. ..... 415/191; 415/115; 415/DIG. 1

[58] Field of Search ..... 415/191, 192, 193, 194, 415/195, 115, DIG. 1

[56] References Cited

U.S. PATENT DOCUMENTS

| | | | |
|---|---|---|---|
| 2,746,672 | 5/1956 | Doll, Jr. et al. | 415/192 |
| 2,801,790 | 8/1957 | Doll, Jr. | 415/192 |
| 2,937,000 | 5/1960 | Ledwith | 415/137 |
| 4,504,189 | 3/1985 | Lings | 415/192 |

FOREIGN PATENT DOCUMENTS

| | | | |
|---|---|---|---|
| 1110068 | 2/1956 | France | 415/193 |
| 104794 | 5/1963 | Netherlands | 415/191 |
| 218193 | 7/1942 | Switzerland | 415/191 |
| 171763 | 6/1960 | Switzerland | 415/192 |

OTHER PUBLICATIONS

*Standard Handbook for Mechanical Engineers,* Baumeister, McGraw-Hill Book Company (1967), pp. 11-82, Baumeister (editor).

*Primary Examiner*—Robert E. Garrett
*Assistant Examiner*—John T. Kwon
*Attorney, Agent, or Firm*—Troxell K. Snyder

[57] ABSTRACT

A stator vane (4) for a gas turbine engine having a varying chordal length (52, 54) is disclosed. The chordal length reduces a maximum (52) at a point intermediate the ends (40, 44) of the vane for defining a radially varying nozzle throat (58, 56) between adjacent vanes (4, 4a) in a stator vane stage.

5 Claims, 4 Drawing Sheets

FIG. 1
PRIOR ART
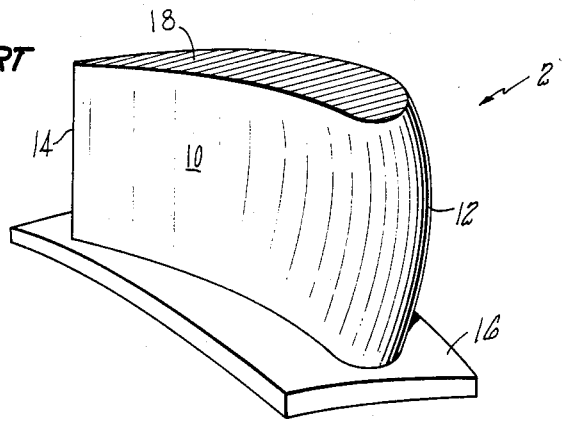
FIG. 2
PRIOR ART
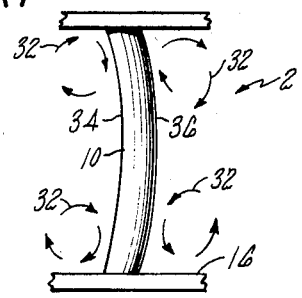
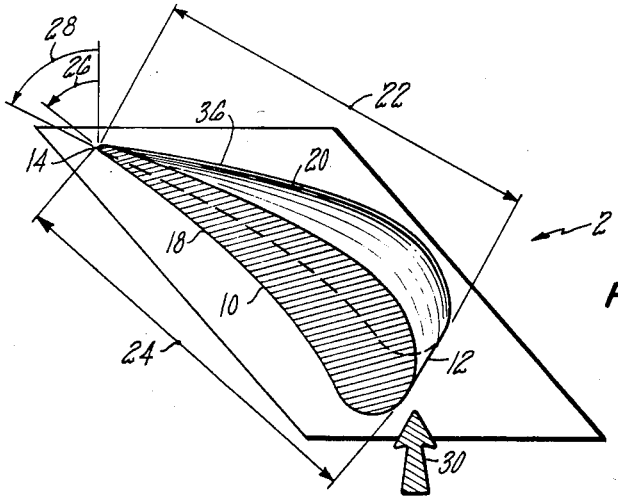
FIG. 3
PRIOR ART

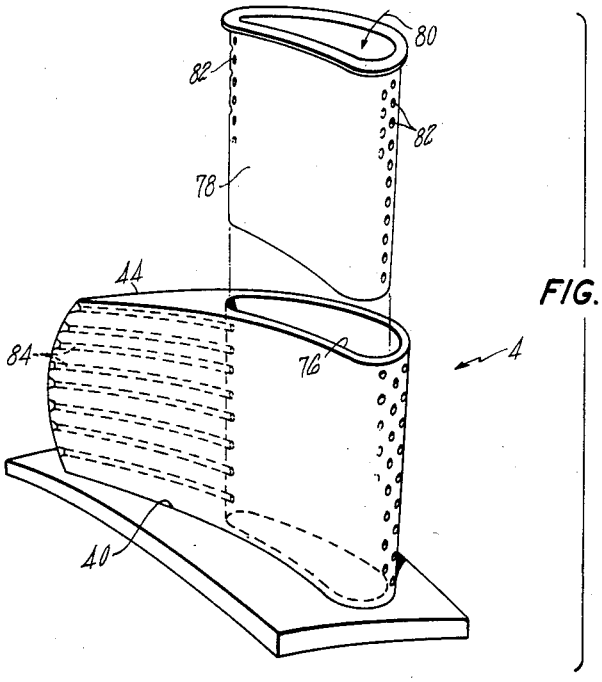
FIG. 7a
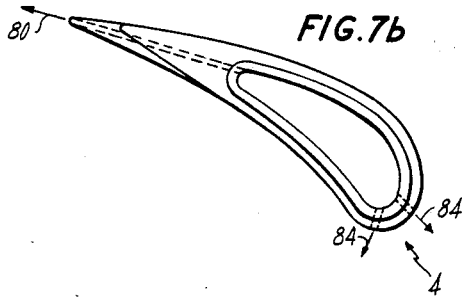
FIG. 7b
FIG. 8
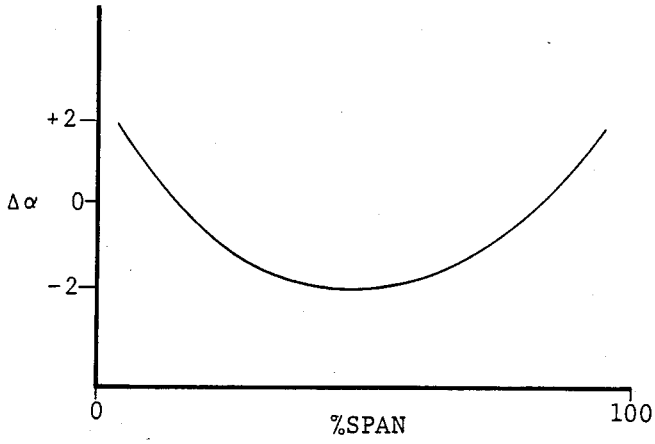

STATOR VANE

FIELD OF THE INVENTION

The present invention relates to a configuration of a stator vane for use in a turbomachine such as a gas turbine engine or the like.

BACKGROUND

In a modern axial flow turbomachine an annular stream of working fluid is conducted through one or more stages wherein energy is exchanged between the rotating turbomachine shaft and the axially flowing working fluid. In an axial flow gas turbine engine, this energy exchange takes place in both directions, with mechanical energy from the shaft transferred into the working fluid in the compressor section of the engine and the reverse occurring in the turbine section of the same engine.

As noted above, this exchange occurs in one or more stages typically comprising a rotor having a plurality of radially extending, rotating blades secured to the turbomachine shaft as well as a plurality of radially extending, fixed vanes disposed immediately upstream of the rotor. The stationary stator vanes serve to optimally direct the annular stream of working fluid into the downstream rotor blades so as to induce the desired amount of momentum transfer.

As will be appreciated by those skilled in the art, the stator vanes do not in themselves effect any transfer of energy between the turbomachine shaft and the working fluid. Rather, the stator vanes function only as a means for enabling the rotating elements of the turbomachine to more effectively interact with the working fluid. Further, it will be appreciated that an optimized velocity profile of the working fluid entering the rotor stage is desirable in order to achieve proper interaction over the spans of the individual blades.

Tests have established that the axial velocity of the working fluid in the first stage of the turbine section of a gas turbine engine is not uniform in the radial direction when measured immediately upstream of the first turbine stage rotor inlet. Specifically, the axial velocity component of the working fluid diminishes adjacent the radially inner and outer boundaries of the annular working fluid stream. Designers have attempted to redistribute the flow of working fluid exiting the stator vane stage in order to optimize the velocity profile at the vane stage exit plane and thereby improve overall engine efficiency.

One method used in the prior art to accomplish this flow distribution is the variation of the size of the nozzle throat formed between adjacent stator vanes to achieve a minimum throat dimension proximate the radial midpoint of the vane. This is accomplished in the prior art by curving the vane span in the vicinity of the vane leading or trailing edge in order to narrow the spacing between adjacent vanes at the vane span midpoint. The resulting spanwise curved vane achieves the desired mass flow redistribution at the exit of the vane stage, but its use has been accompanied by a number of operational drawbacks which have limited its effectiveness.

One drawback of the prior art curved span vane design is its tendency to induce undesirable body forces which degrade the optimum velocity profile as the flow moves axially downstream toward the rotor inlet. The resulting non-optimum velocity profile at the rotor inlet minimizes the benefits achieved from nozzle throat dimension variation.

A second drawback occurs particularly in those vanes immediately downstream of the combustor section in a gas turbine engine which require some form of internal cooling in order to withstand the high temperature environment. Curved span blades of the prior art are less easily fitted with internal cooling gas impingement structures for creating a high rate of heat transfer with a limited flow of cooling medium.

A third drawback of a curved span design vane is its non-uniform surface pressure distribution which is a direct result of the non-uniform airfoil cross-section required for nozzle throat dimension variation. The non-uniform surface pressure distribution induces a spanwise pressure gradient which in turn results in aerodynamic losses that diminish overall engine output.

What is required is a stator vane configuration which achieves and maintains the desired uniform velocity profile at the downstream rotor stage inlet while avoiding the losses and other drawbacks associated with prior art curved span vane designs.

SUMMARY OF THE INVENTION

It is therefore an object of the present invention to provide a stator vane configuration for use in a gas turbine engine or the like.

It is further an object of the present invention to provide a stator vane configuration which provides a stable, optimum working fluid velocity profile downstream of the vane stage.

It is further an object of the present invention to accomplish this optimum downstream working fluid velocity distribution by varying the size of the nozzle throat formed between circumferentially adjacent stator vanes, the nozzle throat having a minimum size at a location intermediate the radially inner and outer ends of the stator vanes.

It is still further an object of the present invention to vary the nozzle throat size without curving the vane airfoil in the spanwise direction.

It is still further an object of the present invention to vary the nozzle throat size without substantially changing the cross sectional shape or orientation of at least the forward portion of the stator vane.

According to the present invention, a stator vane configuration is provided with a chordal dimension varying over the span of the vane from a maximum value proximate the vane midspan and decreasing radially inwardly and outwardly therefrom. When arranged in a stage with a circumferentially distributed plurality of similarly configured vanes, the vane configuration according to the present invention achieves a radially varying nozzle throat size for inducing a greater working fluid mass flow adjacent the radially inner and outer vane ends. The flow modification thus induced results in a more desirable working fluid axial velocity profile entering the downstream rotor stage.

Specifically, the vane according to the present invention accomplishes the variation of the chordal dimension by changing only the downstream portion of the vane cross section to achieve the desired chordal dimension and throat size over the vane span. It is a further feature of the present invention that the shape of the suction side of the vane cross section remains substantially similar in shape over the span of the vane, with the downstream portion of the pressure side of the vane cross section being reconfigured to fair the upstream pressure surface into the trailing edge.

The varying chord vane according to the present invention thus maintains a substantially similar forward cross section and suction surface shape over the blade span. Such consistency allows the use of easily insertable, internal heat transfer structures for cooling the vane as well as avoiding any degradation of vane performance caused by non-uniform surface pressure distribution over radially spaced portions of an individual vane. In addition, the uniform shape of the vane surfaces in the radial direction and the linear vane span avoids inducing a spanwise vane surface pressure gradient as well as undesirable axial vortex flow between adjacent vanes as compared to the prior art, curved span vanes.

BRIEF DESCRIPTION OF THE DRAWINGS

FIG. 1 is a perspective view of a prior art, varying throat, stator vane.

FIG. 2 is an axial view of a single prior art vane.

FIG. 3 is a radially inward-looking view of a prior art vane.

FIG. 7*a* is a perspective view of the vane according to the present invention showing insertion of a heat transfer augmentation structure.

FIG. 7*b* is a cross-section of the vane of FIG. 7*a*.

FIG. 8 is a graph of vane trailing edge angle variation with respect to vane span for a vane according to the present invention.

DETAILED DESCRIPTION

1. Curved Span Vanes

Figure 4:
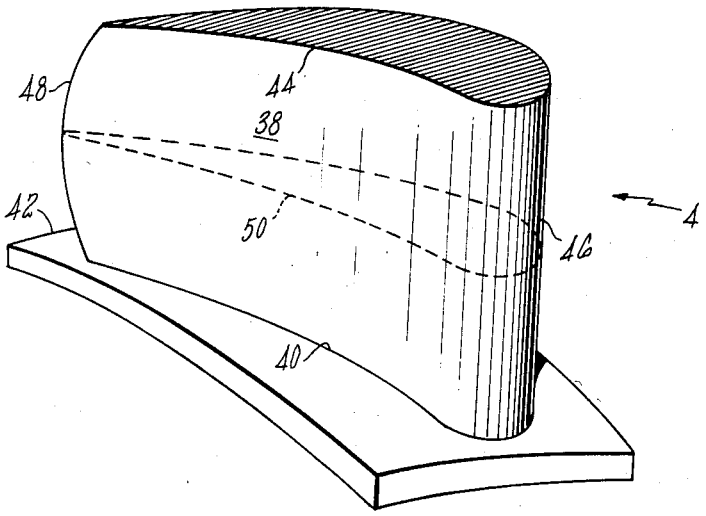
FIG. 4 is a perspective view of a stator vane according to the present invention.

FIGS. 1–3 show a prior art stator vane 2 for forming a varying nozzle throat with respect to radial displacement along the vane span. FIG. 1 shows such a prior art vane 2 having an airfoil body 10 with a curved span leading edge 12 and a substantially linear trailing edge 14. The airfoil body 10 is secured at the radially inward end to a platform 16. The radially outward airfoil body end is also typically secured to a similar transversely extending member which is not shown here for clarity.

The perspective view of FIG. 1 may best be appreciated with reference to FIG. 3 which shows a radially inward looking view of the prior art vane 2. In FIG. 3, the airfoil body 10 is shown having a cross section noted by reference numeral 18 at the radially inward and radially outward ends thereof, and a cross section denoted 20 at or near the body midspan. The suction side 36 is thus displaced circumferentially along the radial span of the vane 2, thereby achieving the varying throat size in conjunction with circumferentially adjacent vanes (not shown).

The airfoil body 10 of the prior art vane 2 as shown in FIG. 3 thus defines a constant chord length over the vane span as denoted by dimensions 22, 24. The curvature of the airfoil span causes a variation of the trailing edge angles 26, 28 in addition to the varying nozzle throat. The result of the varying throat size and trailing edge angle in the prior art vanes is the realization of an optimum axial gas velocity profile at the vane stage exit plane. As noted above, however, this optimum profile has been found to deteriorate rapidly between the vane stage exit and the adjacent, downstream rotor inlet.

As will be appreciated by those skilled in the art of turbomachinery, the curvature of the span of the airfoil body 10 of the prior art vane 2 results in a reorientation and reshaping of the airfoil body cross section 18, 20 over the span of the vane. For the arrangement shown in FIG. 3, the non-uniform airfoil sections 18, 20 experience non-uniform surface pressure distributions which in turn creates undesirable spanwise pressure gradients over the vane surface. These pressure gradients, in addition to a body force exerted on the working fluid by the curved airfoil body 10, induce an undesirable radial fluid mass flow 32 away from the radially inner and outer flow boundaries. The effect of this localized radial flow is a degradation of the otherwise optimal axial gas velocity profile exiting the vane stage.

Another drawback discussed hereinabove may be appreciated by observing FIGS. 2 and 3 with regard to the possibility of inserting a heat transfer impingement structure or other flow directing structure into the spanwisely curved airfoil body. Such impingement structures would require careful shaping and insertion to avoid jamming or breakage in the curved body interior volume (not shown).

This brief discussion of the prior art vane 2 is completed by noting that although shown in FIGS. 1–3 as having a curved span in the vicinity of the blade leading edge 12, it is also known in the prior art to alternatively curve the trailing edge 14 in a similar fashion to achieve the same spanwise variation of nozzle throat size and exit angle. Such configurations are no more effective than the prior art embodiments of FIGS. 1–3.

2. Best Mode for Carrying Out the Invention

FIG. 4 shows a perspective view of the stator vane 4 according to the present invention. The vane 4 includes an airfoil body 38 extending spanwisely across an annularly flowing stream of working fluid (not shown) and being secured at the radially inner, or root, end 40 to a platform 42 as shown in the Figure.

The radially outer, or tip, end 44 is also secured to an outer platform or other structure (not shown) forming the radially outward cylindrical boundary of the annular working fluid flow stream. The airfoil body includes a leading edge 46 and a trailing edge 48, and defines a plurality of airfoil cross sections shown representatively at the radially inner and outer ends 40, 44 and at the vane midspan 50.

Figure 5:
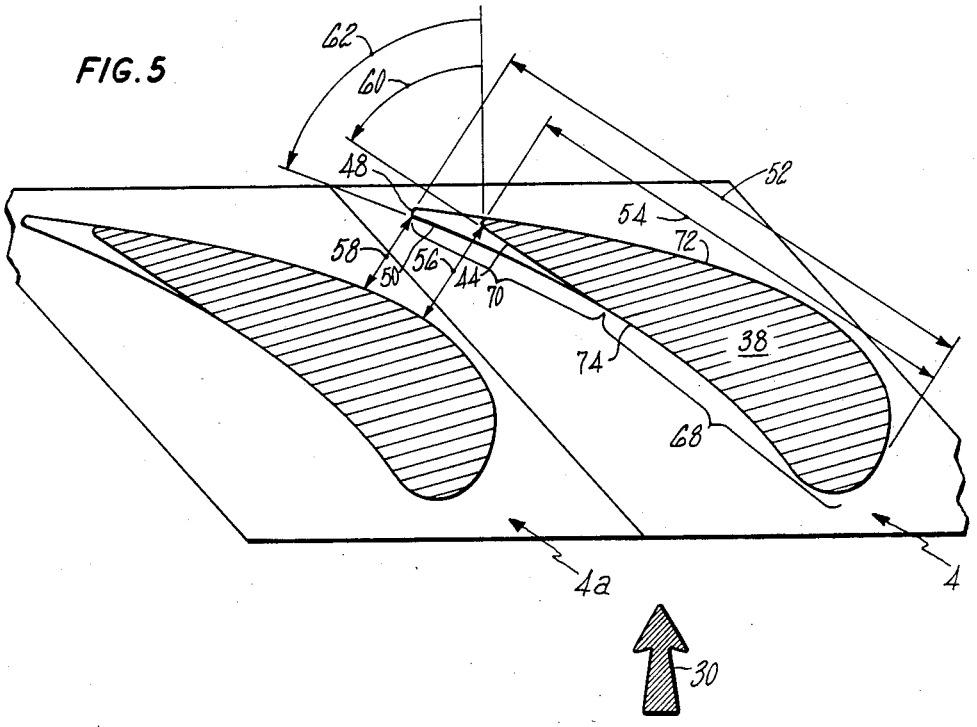
FIG. 5 is a radially inward-looking view of a pair of vanes according to the present invention.
Figure 6A:
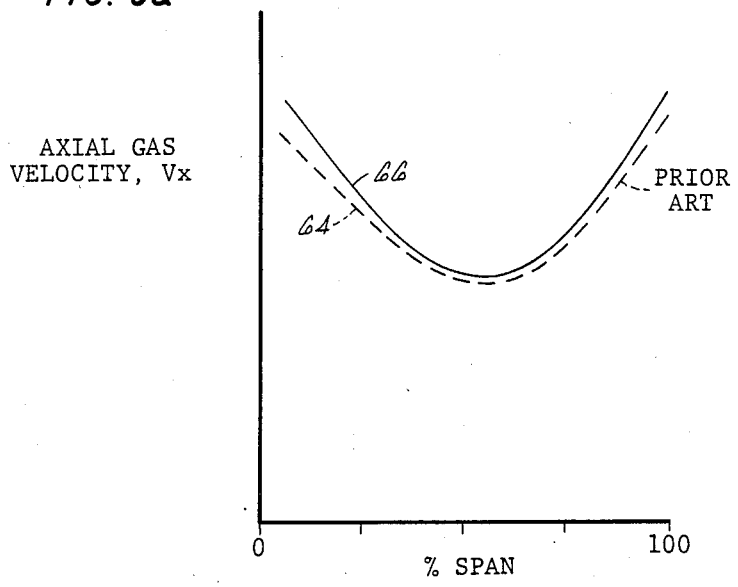
FIG. 6*a* shows an axial velocity distribution taken at the exit plane of a stage of stator vanes according to the present invention compared to a like distribution for a stage of prior art stator vanes.
Figure 6B:
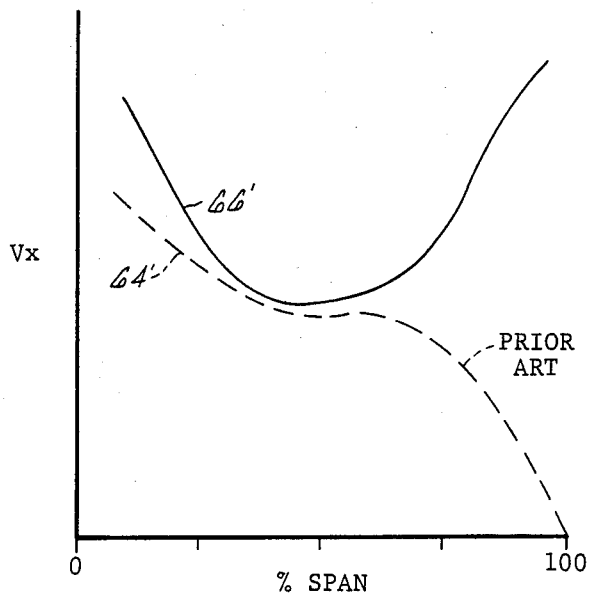
FIG. 6*b* shows axial velocity distributions of the same two stages of vanes, but taken at the inlet plane of the adjacent downstream rotor stage.

It will be readily apparent by observing FIGS. 4 and 5 that the vane 4 according to the present invention, while being substantially linear in the spanwise direction, also defines a substantial variation in the airfoil chordal dimension between the midspan 50 and the root and tip ends 40, 44. As shown clearly in FIG. 5, the chordal dimension 52 at the blade midspan is significantly greater than the chordal dimension 54 at the vane outer end 44 and inner end 40 (not shown in FIG. 5).

This variation in chordal dimension 52, 54 over the span of the airfoil body 38 results in a variation of the stator vane throat size as defined between two circumferentially adjacent vanes 4, 4*a* configured according to the present invention. The nozzle throat 56 defined at the vane outer end 44 is larger than the nozzle throat 58 defined at the blade midspan. Additionally, the magnitude of the nozzle exit angle 60 measured at the trailing edge of the vane tip 44 is less than that of the exit angle 62 measured at the vane midspan 50. The vane configuration according to the present invention thus increases the axial velocity component of the working fluid adjacent the radially inward and outward portions of the annular working fluid stream by reducing the nozzle throat in the vane midspan and increasing working fluid mass flow adjacent the annulus boundaries.

FIGS. *6a* and *6b* represent experimental and computational data supporting the effectiveness of the vane configuration according to the present invention. FIGS. *6a, 6b* show axial velocity, $V_x$, plotted vertically against percent vane span on the horizontal axis. Zero percent span corresponds to the radially inner end 40 of the vane while 100 percent span corresponds to the radially outer end 44. As can be seen in FIG. *6a*, both the prior art vane 2 and the vane according to the present invention 4 provide similar respective axial gas velocity profiles 64, 66 at the gas exit plane of the respective stator vane stages.

The vane stage according to the present invention, however, maintains this optimal gas velocity profile downstream of the vane stage at the entrance plane of the adjacent rotor blade stage as shown by the solid curve 66' in FIG. *6b*. Conversely, the velocity profile 64' of the prior art vane stage is severely degraded by the time the gas flow has reached the downstream rotor stage inlet, reducing both the effectiveness of that particular rotor stage as well as overall engine efficiency.

As noted above, this degradation in the prior art arrangement results from the non-axial mass flow 32 resulting from the body forces and spanwise pressure gradients inherent in the prior art curved span configuration. The velocity profile 66' produced by the vane 4 according to the present invention exhibits no such degradation, remaining essentially optimal until entering the adjacent downstream rotor stage.

This optimal profile in the area of the inner and outer annular radii is achieved at least in part by the constant shape of the airfoil body 38 along the span of the blade 4. Referring again to FIG. 5, it is immediately apparent that the upstream portion 68 of the vane 4 is substantially unchanged along the blade span, while the downstream portion 70 is altered dramatically. Moreover, it should also be apparent that the suction side 72 of the vane airfoil body 38 also remains unchanged in shape even in the downstream portion 70 while the pressure side 74 is faired into the trailing edge 48 in order to accommodate the alteration in chordal dimension over the vane span.

The benefits of maintaining an unchanging cross section in the upstream portion 68 and in the shape of the suction surface 72 in the airfoil body 38 should be apparent to those skilled in the art of gaseous flow. The suction surface 72 may be shaped optimally and uniformly to produce the most efficient vane-working fluid interaction while avoiding the need to compromise suction surface shape in order to achieve the variation in nozzle throat along the vane span. Any alterations in the airfoil body cross section necessary to accommodate the variation in chordal length 52, 54 is accommodated by fairing the pressure surface 74 in the downstream portion 70 of the airfoil body 38 between the upstream portion 68 and the trailing edge 48. The resulting design avoids creating undesirable spanwise surface pressure gradients as well as the body forces of the prior art designs.

Another advantage of the linear span airfoil body configuration of the vane according to the present invention is illustrated in FIG. *7a* wherein the vane 4 according to the present invention is shown having an internal cooling cavity 76 extending spanwisely between the radially inner end 40 and the radially outer end 44. The cavity 76 is adapted for receiving an internal heat transfer augmentation structure 78 such as the impingement tube shown in the removed position in FIG. *7a*.

The impingement tube 78 operates by receiving a flow of cooling gas 80, such as air, into the tube interior and directing it outward against the interior surface of the cavity 76 through a plurality of impingement openings 82. As shown in FIG. *7b*, cooling air exiting the impingement openings 82 impacts the interior of the cavity 76 at relatively high velocity thus achieving a high rate of heat transfer between the vane material and a given flow of cooling gas. After absorbing heat from the interior wall of the vane 4, the cooling air 80 may exit the vane 4 either radially or through transpiration openings 84 shown typically in FIGS. *7a* and *7b*.

As will be appreciated by those skilled in the art of internal vane air cooling, it is extremely beneficial to employ an easily removable heat transfer augmentation structure 78 in a high temperature turbomachine environment. By providing a substantially constant cross section airfoil body 38 having a linear span, the vane according to the present invention permits the configuration to accept a substantially linear impingement tube 78 or the like within an internal cavity 76. Such a linear tube 78 is easily slipped into and out of the individual vanes 4 facilitating replacement, repair, and cleaning as well as reducing the likelihood of jamming or breakage of this typically lightweight and fragile structure.

In depicting the shapes and variations present in the vane according to the present invention, it has been necessary to exaggerate the physical appearance in FIGS. 4 and 5 in order to illustrate these features with sufficient clarity. The actual magnitude of such variations, while clearly visible during a physical inspection of an actual stator vane, are in reality much less dramatic as may be appreciated by an examination of FIG. 8 which plots the clockwise variation of the trailing edge angle, delta alpha, on the vertical axis and percent vane span on the horizontal axis.

For a typical stator vane disposed immediately downstream of the combustor section in a gas turbine engine, a stator vane according to the present invention exhibits a plus or minus 2° variation in the trailing edge angle as a result of the variation of the chordal dimension over the vane span. This slight variation, in addition to the variation of the nozzle throat size from a minimum at a point intermediate the ends of the vane 4 and increasing with radially inward and outward displacement therefrom, results in a sufficient modification of the radial working fluid velocity distribution to achieve the profiles depicted in FIGS. *6a* and *6b*.

It will further be appreciated by those skilled in the art that the precise vane configuration shown in the drawing Figures is but one of a wide variety of similar configurations and constructions which fall within the scope of the present invention.

We claim:

1. A stator vane for a turbomachine, said vane extending spanwisely across an annular stream of axially flowing working fluid comprising:

an airfoil body for redirecting the fluid stream, including a concave pressure surface, a convex suction surface, a substantially linear leading edge, a trailing edge, and wherein the leading and trailing edges of the airfoil body define a spanwisely varying chord length therebetween, the chord length reaching a maximum at a point intermediate the radially spaced ends of the vane and decreasing with relative spanwise displacement from said point.

2. The stator vane as recited in claim 1, wherein the cross sectional configuration of the suction surface of the airfoil body is substantially uniform over the span of the vane, and wherein at least a portion of the cross sectional configuration of the pressure surface of the airfoil body changes over the span of the vane.

3. The stator vane as recited in claim 2, wherein the changing portion of the cross sectional configuration of the pressure surface of the airfoil body is disposed adjacent the trailing edge.

4. A turbomachine stator vane stage having a plurality of circumferentially distributed, individual vanes extending spanwisely across an annular stream of an axially flowing working fluid, wherein each individual vane comprises:

a substantially linear leading edge, an axially spaced trailing edge, and a pressure surface and a suction surface extending therebetween;

the leading and trailing edges further defining a chordal length therebetween, said chordal length increasing in magnitude with increasing spanwise displacement in the radially outward direction, reaching a maximum at a point intermediate the ends of the vane and decreasing with further radially outward spanwise displacement beyond said point.

5. A stator vane stage for a turbomachine wherein circumferentially adjacent airfoil vanes define an exit nozzle throat therebetween for conducting an axially flowing annular stream of working fluid therethrough, characterized in that each airfoil vane chordal length varies with displacement along the vane span, reaching a maximum at a point intermediate the vane ends, thereby defining an exit nozzle throat varying in size over the span of the vane.

* * * * *

UNITED STATES PATENT AND TRADEMARK OFFICE

CERTIFICATE OF CORRECTION

PATENT NO. : 4,741,667

DATED : May 3, 1988

INVENTOR(S) : Francis R. Price and Charles B. Titus

It is certified that error appears in the above-identified patent and that said Letters Patent is hereby corrected as shown below:

In the Abstract, line 3, "reduces" should be --reaches--

Signed and Sealed this

Twentieth Day of September, 1988

*Attest:*

DONALD J. QUIGG

*Attesting Officer*

*Commissioner of Patents and Trademarks*